US010315882B2

(12) United States Patent
Priem et al.

(10) Patent No.: US 10,315,882 B2
(45) Date of Patent: Jun. 11, 2019

(54) SPOOL FIXATION DEVICE WITH BI-STABLE MAGNET ASSEMBLIES

(71) Applicant: NV BEKAERT SA, Zwevegem (BE)

(72) Inventors: Johan Priem, Roeselare (BE); Johan Hugelier, Harelbeke (BE)

(73) Assignee: NV BEKAERT SA, Zwevegem (BE)

( * ) Notice: Subject to any disclaimer, the term of this patent is extended or adjusted under 35 U.S.C. 154(b) by 274 days.

(21) Appl. No.: 15/106,016

(22) PCT Filed: Jan. 8, 2015

(86) PCT No.: PCT/EP2015/050227
§ 371 (c)(1),
(2) Date: Jun. 17, 2016

(87) PCT Pub. No.: WO2015/104315
PCT Pub. Date: Jul. 16, 2015

(65) Prior Publication Data

US 2016/0318732 A1 Nov. 3, 2016

(30) Foreign Application Priority Data

Jan. 13, 2014 (EP) ..... 14150988

(51) Int. Cl.
*H01F 7/02* (2006.01)
*H01F 7/04* (2006.01)
(Continued)

(52) U.S. Cl.
CPC ..... *B65H 49/36* (2013.01); *B65H 54/543* (2013.01); *H01F 7/0257* (2013.01); *H01F 7/04* (2013.01); *B65H 2701/36* (2013.01)

(58) Field of Classification Search
CPC .... B65H 49/36; B65H 54/543; B65H 54/547; B65H 2701/36; H01F 7/04
See application file for complete search history.

(56) References Cited

U.S. PATENT DOCUMENTS 2,561,155 A 7/1951 Thomas, Jr. et al.
3,396,919 A 8/1968 Vayda
(Continued)

FOREIGN PATENT DOCUMENTS

DE 945322 C 7/1956
EP 0337052 A1 10/1989
(Continued)

OTHER PUBLICATIONS

Machine Translation of WO 2005/095254, Oct. 13, 2005. (Year: 2005).*
(Continued)

*Primary Examiner* — William E Dondero
(74) *Attorney, Agent, or Firm* — Bacon & Thomas, PLLC

(57) ABSTRACT

A spool fixation device for use in a wire winding installation, where in this spool fixation device, spools having a magnetically attractable flange are held to a rotatable flange using magnet assemblies. The magnet assemblies can be switched between a 'hold' state and a 'release' state. In a preferred embodiment the magnet assemblies only consume energy when in the 'release' state i.e. when the spool fixation device is not rotating. Alternatively the magnet assemblies can be made to only consume energy when switching states. The magnet assemblies have permanent magnet arrays and are moveable inside a non-magnetic housing. Also a drive pin to transfer torque between rotatable flange and spool is no longer necessary. Therefore the spool fixation devices allows for a smooth changeover of spools.

13 Claims, 5 Drawing Sheets

(51) Int. Cl.
*B65H 49/36* (2006.01)
*B65H 54/54* (2006.01)

(56) References Cited

U.S. PATENT DOCUMENTS

| | | | | |
|---|---|---|---|---|
| 5,709,347 | A * | 1/1998 | Hoffmann | B65H 59/04 192/69.42 |
| 2016/0125989 | A1 * | 5/2016 | Altknecht | G11B 15/662 335/295 |

FOREIGN PATENT DOCUMENTS

| | | | |
|---|---|---|---|
| EP | 0755891 | A1 | 1/1997 |
| WO | 01/43147 | A1 | 6/2001 |
| WO | 2005/095254 | A1 | 10/2005 |

OTHER PUBLICATIONS

Machine Translation of Claims of DE 945 322, Jul. 5, 1956. (Year: 1956).*
International Search Report (ISR) dated Feb. 27, 2015, for PCT/EP2015/050227.

* cited by examiner

SPOOL FIXATION DEVICE WITH BI-STABLE MAGNET ASSEMBLIES

The invention relates to a spool fixation device for use in a pay-off or take-up unit of wire handling or processing machinery.

BACKGROUND ART

Wires of long length are carried on spools of all kinds. These spools enable the efficient transport and handling of the wire without the wire getting entangled or the end getting lost. Wire spools are rotating in machinery on rotatable axes supported at both ends, cantilever axes with a counter fixture, on vertical spindles or between two rotatable pintles. As the spools are many times running at high to very high speeds it is a matter of elementary safety that they should be held firmly during rotation.

When a spool runs empty (or full) their replacement with full (or empty) spools should go smoothly, safe and with little effort in order not to lose time in the production process. Sometimes spools are well adapted for their use in unwinding but may not be optimal for winding wire on. For example the bore hole of a spool may be small and sufficient for the use on an axis of a pay-off installation running at low speed and low tension. Unfortunately, the same bore hole size may not be adequate to use the same spool on a take-up unit where winding forces and winding speeds are higher.

This becomes particularly relevant when the wire is rather heavy such as in the case of metal wires like steel wires, steel filaments or steel cords. The weight of wire held by the spool is high due to the high specific weight of steel and the long lengths involved. The mass of wire held by a spool may vary between 5 kg to 500 kg while the spool itself may weigh between 0.5 to 50 kg.

Typically spools are mounted by sliding the bore hole over a cantilevered shaft mounted on a rotatable disc. A cantilever mount is many times preferred as the side opposite to the rotatable disc remains free and accessible to the operator. No counter support is needed provided the spindle has sufficient diameter to hold the load. Only a chuck is needed to secure the spool on the spindle. Usually a drive pin is mounted on the rotatable disc that engages with an off-centre drive hole in the spool. In this way torque is transferred between the driven or braked rotatable disc and the spool. The loading of an empty spool can be pretty challenging for the operator in that he must first aim to insert the shaft into the bore hole and then to engage the drive hole with the drive pin. Any improvement made to the loading or unloading of empty or full spools on a steel wire processing installation is therefore welcomed.

Various solutions have been suggested to hold spools on their shafts, in particular for cantilever mounted spools. As the spools used are generally made of steel that can be attracted by a magnet it may therefore seem a plausible solution to use magnetic force to hold the spools to the installation. However, the use of magnetic forces to mount spools seems in general to be disliked:

When electromagnets are used a constant supply of current is needed towards a turning disc implying a rotative electrical contact. The rotative contact is prone to wear. Upon an electricity failure, the spools are no longer held and can come lose from the spindle. Also electromagnets do consume a lot of energy when active.

Permanent magnets—as described in U.S. Pat. No. 3,396,919—can only be used for spools with low masses as the spools have to be pulled off from the rotatable disc thereby overcoming the magnetic attractive force. For heavy and full spools such force is difficult to overcome manually.

The inventors have therefore come up with the following solution.

SUMMARY OF THE INVENTION

The primary object of the invention is to improve on the existing art of spool fixation in wire winding installations, more specifically steel wire—such as steel filament or steel cord—installations. It is an object of the invention to make spool replacement to go swift, effortless and safe for the operator while not consuming a lot of energy of any kind. It is a further object of the invention to be able to process small bore hole spools in a cantilever mount. It is a still another object to dispense with the need of having a drive pin to transfer torque from the spool fixation device to the spool.

According a first aspect of the invention, a spool fixation device is claimed that primarily comprises a rotatable flange for holding a spool. The rotatable flange is rotatably attached to the wire winding installation and can be driven or braked or turn freely. The spool to be used must at least have a flange that is magnetically attractable. Most metal spools made of steel sheet are suitable. The rotatable flange is provided with one or more magnet assemblies. The magnet assemblies are mounted directionally compliant to the rotatable flange. Characteristic about the device is that the one or more magnet assemblies can be set to a 'hold' state for magnetically holding the flange of the spool against the rotatable flange or can be set to a 'release state' for removing the spool from the flange.

The magnet assemblies are by preference radially mounted around the axis of rotation of the rotatable flange. Angularly the magnet assemblies are distributed in agreement with the symmetry of the spool flange contacted by the magnet assemblies. The spool flange may have reinforcement ribs on which the magnet assemblies have little grip. So the magnet assemblies are mounted in positions between those reinforcement ribs where there is a flat surface.

Typically four to eight magnet assemblies are mounted on the rotatable flange, although nothing forbids that less (one, two or three for example) or more (up to twelve for example) can be used in order to ensure sufficient holding force. The more magnet assemblies are present the more holding force but also the more costly the whole device becomes.

The magnet assemblies are mounted 'directionally compliant' to the rotatable flange. Thereby it is meant that the surface of the magnet assembly that comes in contact with the flange of the spool can slightly swivel but not significantly translate (less than 5 mm) perpendicular to the rotatable flange. This allows the magnet assembly to take that orientation that results in the largest possible magnetic holding force. Typically the normal to the spool contacting surface of the magnet assembly can deviate up to 5° from the normal on the rotatable flange. This directional compliancy can be achieved by means of an axial retainer means such as a bolt with spring washers, ball joint, or elastomeric joint.

The geometrical area of the magnet assembly that comes into contact with the spool flange may be adapted for maximal surface contact to the flange. If the spool flange is separated in sectors by the radial reinforcement ribs, the contact surface of the magnet assembly may be of substantially triangular shape, fitting into the flange sector. Alternatively the contacting surface may be of circular, square or segment shape.

According a first preferred embodiment each magnet assembly comprises a permanent magnet array that is sealed from the outside in a housing. The housing must be substantially non-magnetic at least in the direction facing the spool flange. The backing may or may not be magnetically attractable. The permanent magnet array comprises a number of individual permanent magnets. Nowadays very strong permanent magnets based on rare-earth metal alloys exist. Typical examples are neodymium-iron-boron ($Nd_2Fe_{14}B$) and cobalt-samarium ($Co_5Sm$) compositions. These materials show high remanent magnetisation and high coercitive fields i.e. have a strong magnetic induction and are difficult to demagnetise making them the ideal materials for use. Alternatively older materials such as 'alnico' (an alloy of iron, aluminium, nickel and cobalt) can also be used. As the high performance magnets are usually prone to corrosion they must be sealed individually (by coating with nickel, copper or embedding them in a resin) and sealed from the outside in a non-magnetic housing made of for example a non-magnetic metal alloy or a polymer housing.

Typically the permanent magnet array will comprise an even number of permanent magnets arranged in a planner pattern with the magnetisation perpendicular to the plane of the magnets. South and North poles of adjacent magnets are opposed so that magnetic field lines fringe out maximally. For the kind of application envisaged and depending on the weight of the full spool, a single permanent magnet array must have a holding force of at least 1 kN, or more than 2 kN or even better than 5 kN. By increasing the number of magnet assemblies in the device the holding force can further be increased.

According a second preferred embodiment the magnet assembly only requires an energy input when in the release state. When the device is in the 'hold' state—i.e. during rotative operation—no energy input is needed. As the spool will only be released from the spool fixation device when it is standing still, energy input is only then required. Once the spool has been removed from the device, the energy input can be stopped again thereby automatically returning the device to the 'hold status'. This is a big advantage in terms of energy and safety compared to for example electromagnets wherein energy input is needed while the spool is rotating and not when it is standing idle.

According a third preferred embodiment of the invention, the magnet assemblies only require an input of energy when switching state. When the magnet is in the 'hold' state or the 'release' state, they remain in that state until a short pulse of energy is fed to the assemblies switching them to their alternate state of 'release' or 'hold'. This embodiment uses even less energy than the second embodiment.

The setting of the state of the magnet assemblies can be done conjointly or in series. The energy input can be one or two out of the group comprising electrical, pneumatical, hydraulical or mechanical energy as will be explained hereinafter. The energy is fed through an energy coupling that can be a rotatable energy coupling between the stationary wire winding installation and the magnet assemblies on the rotatable disc. However, due to the fact that only energy must be supplied when the rotatable flange is standing still i.e. during unloading or loading of a spool, this coupling needs only be realised at stand still which greatly reduces the cost of the coupling and greatly increases safety of the spool fixation device. This in contrast with for example electromagnetic assemblies where the electrical coupling must remain established during operation. Any loss of current supply during operation (for example due to a failing electrical contact or a power trip) results in a release of the spool which is highly dangerous situation. Preferably, the coupling is coaxial to the axis of rotation of the rotatable flange. The stationary part of the coupling is considered part of the spool fixation device (whether in a coupled state or not).

The making or breaking of the coupling may also need an energy input. A preferred embodiment of the energy coupling is an energy coupling which is physically made and broken by the same type of energy that is transferred. The coupling is broken when the spool fixation device is operative and is active when the spool fixation device is stationary. For example the coupling of pneumatic energy is activated or broken between installation and magnet assemblies by means of pneumatic energy. Even more preferred is that the coupling is realised by the very same energy input as the energy input to the magnet assemblies. For example an electrical connection between installation and magnet assembly is made or broken by the current running through the coupling to the magnetic assembly.

In a fourth preferred embodiment the permanent magnet arrays are alternatingly moveable in said magnet assemblies from a position close to the spool flange for strong attraction of the spool flange—i.e. when in the 'hold' state—to a remote position away from the spool flange for weak attraction of the spool flange—i.e. when in the 'release' state. As the magnetic field attraction readily drops of with distance (with the inverse cube of distance) the attraction is short ranged and the close and remote position need not be that far from one another. For example a few centimeter suffices to have the spool released.

However, in order to come from a 'hold' state to a 'release' state the holding power of each individual permanent magnet array must be overcome. Therefore an energy input is needed. Preferably this is done by a pneumatic system wherein a pressurised fluid is used to separate the permanent magnet from the spool flange and to move it sufficiently far away so that the attractive force becomes negligible. Typically a pressure of 2 to 6 bar is needed. When now a mechanical spring is mounted behind the permanent magnet, the permanent magnet will remain in remote position as long as the pressure is on and the spring will move the permanent magnet to the close position when the pressure is removed. Instead of a mechanical spring, a pneumatic spring can be used. So two types of energy input are used: pneumatical and mechanical or pneumatical Alternatives are that an electromagnet is used to move the permanent magnet from the close position to the remote position. A pulse of electrical current (i.e. energy) will have to be supplied in order to pull back the permanent magnet. By putting a ferromagnetic backing plate to the non-magnetic housing, the permanent magnet can be held in remote position without supply of current. By giving a reverse pulse of current to the electromagnet the permanent magnet can be moved into the close position. In this case both inputs of energy are electrical.

In a fifth preferred embodiment, the permanent magnet array can be shunted to make the array inactive. By relatively moving a magnetic shunt in between the permanent magnet array and the spool flange the field of the permanent magnet array is diverted into the shunt and the spool flange is released. Alternatively when the magnetic shunt is turned away from before the permanent magnet assembly, the magnetic field of the permanent magnets can extend into the spool flange and attract the spool. A magnetic shunt is a ferromagnetic piece of material of for example iron.

In a further improvement of the spool fixation device the magnet assemblies are provided with a high-friction layer at least at the surface area intended to contact the spool flange. As friction is determined by the interaction of on the one side the surface of the spool and at the other side the high-friction layer, both those surfaces can be optimised for optimal friction. For example the surface of the spool contacting the magnet assembly can be made rough or serrated while the high-friction layer is made of a rubber (or just the other way around). Alternatively, when the surface of the spool is very smooth—in case of e.g. a painted spool—the rubber pad on the magnet assembly may be provided with flexible suction cups. A high friction between spool surface and magnet assemblies is desirable as when the spool is driven considerable shear forces occur between the spool flange and the magnet assembly. Hence, not only the spool retention perpendicular to the rotatable flange must be high, but also in shear direction i.e. in the plane of the rotatable flange. Alternatively, when reinforcing ribs are present on the spool flange, these ribs may prevent gliding of the magnet assembly on to the spool flange when torque is applied to the spool.

A drive pin on the rotatable flange and a fitting drive hole in the spool are therefore no longer necessary in the spool fixation device according the invention. This greatly facilitates the mounting of the spool as the operator does not longer has to aim to engage the drive pin into the drive hole of the spool.

A centering pin remains necessary to keep the spool to be held in the centre of the rotatable plate. An off-centre spool cannot be tolerated. However, the centering pin does not have to extend through the complete bore hole due to the fact that the spool is also carried by the rotatable flange. In addition spools with small bore hole can also be processed on the wire winding installation with this spool fixation device. In prior-art wire winding installations using spools with small bore holes (say 33 mm or less) the shafts are subject to fatigue as all weight and wire forces are transmitted to the shaft. As now a considerable force is taken by the rotatable flange small diameter centering pins can be allowed and do not even have to span the whole width of the spool.

However, for even heavier spools a centering pin or shaft extending about the width of the spool can still be used. In that case a counter centre or holding chuck can be provided at the end opposite to the rotatable flange in order to secure the spool additionally.

According a second aspect of the invention, a wire winding installation is claimed. The wire winding installation can be a pay-off or take-up installation comprising one or several spool fixation devices according the invention as disclosed above and in the claims. Such a winding installation can take small bore hole spools without a drive hole.

According a third aspect of the invention a wire spool that is specifically suitable for use with the spool fixation device is disclosed. The spool has at least one flange that is magnetically attractable. Therefore sufficient magnetisable metal must be present. Steel sheets with thickness between 1 to 4 mm such as 3 mm will generally suffice to be held magnetically. Typically spools with a full load mass between 10 and 800 kilograms are envisaged to be used with the spool fixation device. Specific about the spools is that at least the areas of the flange that are contactable by the magnet assemblies are provided with an anti-slip coating. This to improve the shear force resistance of the spool fixation device.

BRIEF DESCRIPTION OF THE DRAWINGS

The first digit in the reference in the numbers refers to the figure number. In FIGS. 2 to 4 equal tens and unit numbers refer to equal or similar items.

DETAILED DESCRIPTION OF THE INVENTION

Figure 1:
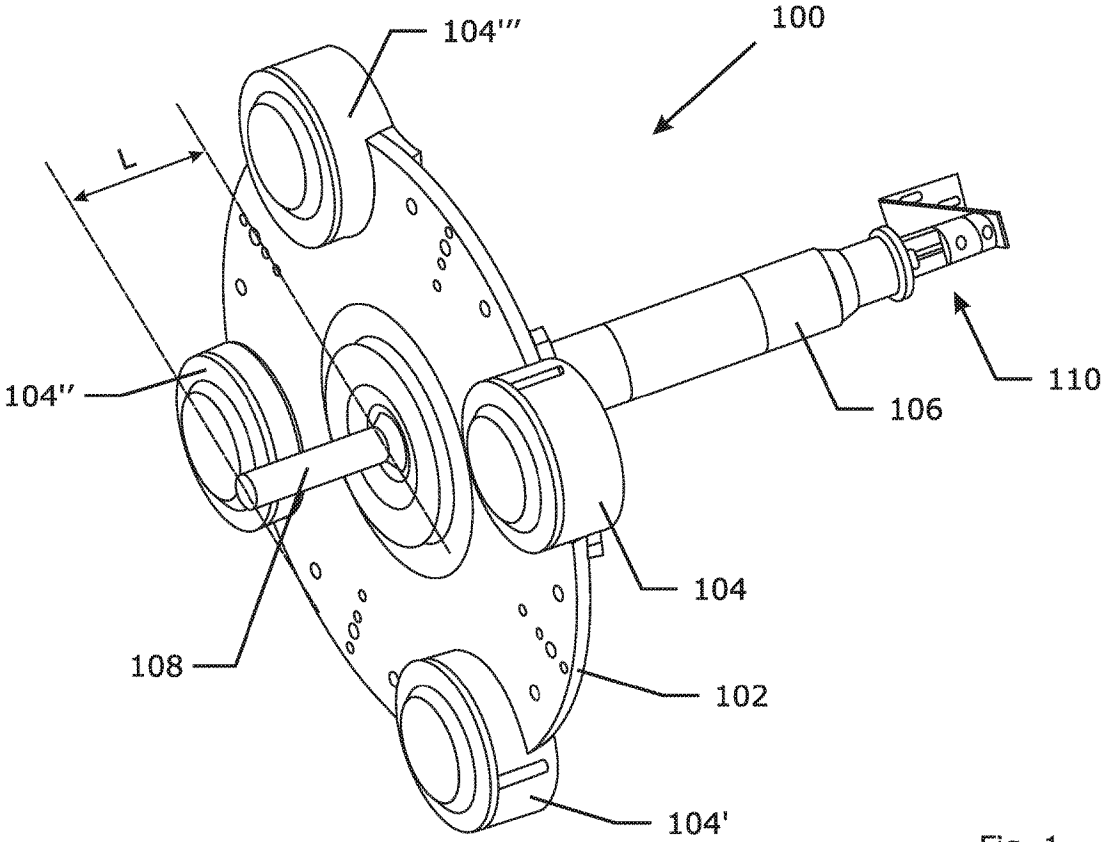
FIG. 1 shows the spool fixation device in perspective view.

A perspective view of the spool fixation device is shown in FIG. 1. Basically the device comprises a rotatable flange 102 on which magnet assemblies 104, 104', 104", 104'" are mounted. The magnet assemblies slightly protrude above the plane of the rotatable flange 102. As known in the art the rotatable flange is mounted fixedly to a co-rotating axis 106. A centering pin 108 is mounted centrally to centre the spool on the spool fixation device. The centering pin 108 protrudes from the rotatable flange 102 with a length 'L'. An energy coupling 110 is provided at the end of the axis 106. The spool fixation device is mounted by the axis 106 in a wire winding installation (not shown) such as a winding bench for 12 or 24 or more spools. The full spools in this kind of installation have a mass of more than 100 kilogram. Note that no drive pin to transfer torque to the spool is present on the rotatable flange 102 as in prior art installations.

The centering pin 108 does not have to extend through the complete bore hole of the spool. When the width of the spool is larger than the length 'L' of the centering pin, the spool is partly carried by the centering pin and partly by the rotatable flange 102 in contrast with prior art installations where the full weight of the spool is carried by the cantilever shafts. Nevertheless the use of a centering pin that extends through the bore hole of the spool i.e. protrudes at the spool flange opposite to the rotatable flange 102 remains possible. In that case the length 'L' of the centering pin is larger than the width of the spool.

Figure 2:
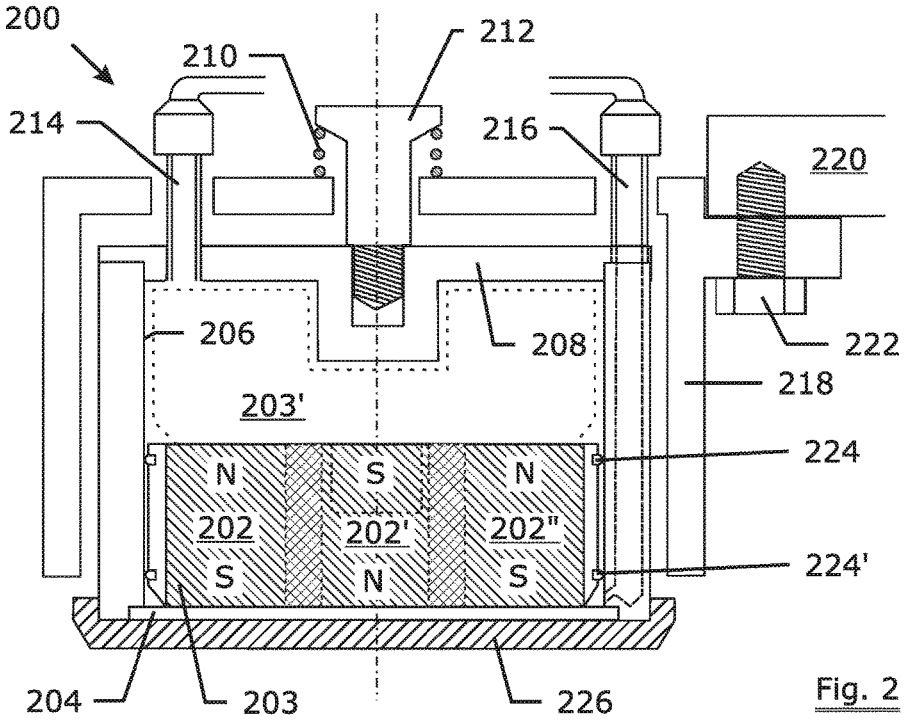
FIG. 2 is a cross-sectional view of a first embodiment of a magnet assembly.

FIG. 2 shows a first embodiment of the magnet assembly 200. The magnet assembly is held in a round box 218 that is fixedly mounted on the rotatable flange 220 by means of bolt 222. The non-magnetic housing consists of a cylindrical body 206 of aluminium with a front cover 204 made of brass. The back cover 208 is made of magnetisable ferritic or martensitic stainless steel. The housing seals the internal permanent magnet array 203 from the outside environment. The magnet array 203 comprises six permanent magnets 202, 202', 202" (other magnets are not shown) arranged in a hexagon and held in a polymeric holder made of cast resin. The permanent magnet's field are arranged alternating between adjacent magnets. The permanent magnets are by preference Hicorex®, high performance magnets of the NdFeB type obtainable from Hitachi Magnetics corporation.

The permanent magnet array 203 can move from a position close to the front cover 204, to a position remote from the front cover indicated with a light dashed line 203' in FIG. 2. To this end the round permanent magnet array 203 is provided with a pair of circumferential sealing rings 224, 224'. The seal rings are by preference high elastic and wear resistant Viton® seal rings. By pressurising the air input 216 the magnet array is pneumatically pushed from the position close to the spool to a position 203' more remote from it. In order to allow the pressure to spread between magnet array and front plate 204 the front plate or the magnet array may have cut-in channels.

The magnet assembly is mounted directionally compliant in the box 218. This is achieved by a spring 210 and bolt 212 mount. In this way the magnet assembly can swivel inside the box 218 but cannot be pulled out as the bolt 212 prevents this.

Once the magnet array has reached the remote position 203', the air pressure can be released as the magnet array is now slightly attracted by the weakly magnetisable back cover 208. When all the magnet arrays in the respective magnet assemblies 104, 104', 104" and 104'" are in the remote position i.e. the 'release' state, the spool can be removed from the spool fixation device as the flange of the spool is released from the rotatable flange 220, 102.

When now an empty spool has been slid over the centre pin 108, the magnet assemblies can be set to the 'hold' state by air pressurising line 214. The magnet array is then moved from the remote position 203' to the close position 203 thereby holding the flange of the spool magnetically. Once the spool flange is attracted by the magnet arrays, the air pressure can be removed and the spool may start turning without any further energy input to the magnet assemblies. This is one of the major advantages of this spool fixation device: there is no need for an energy input to hold the spool during operation. Another advantage of this embodiment is that only an air pulse is needed when changing state.

In order to increase the shear force resistance of the spool flange relative to the magnet assembly during winding, the front cover 204 is provided with a vulcanised rubber layer 226. This rubber layer adheres very well to the brass front cover 204. By preference it is less than 1 mm thick in order not to weaken the magnetic attraction.

Figure 3:
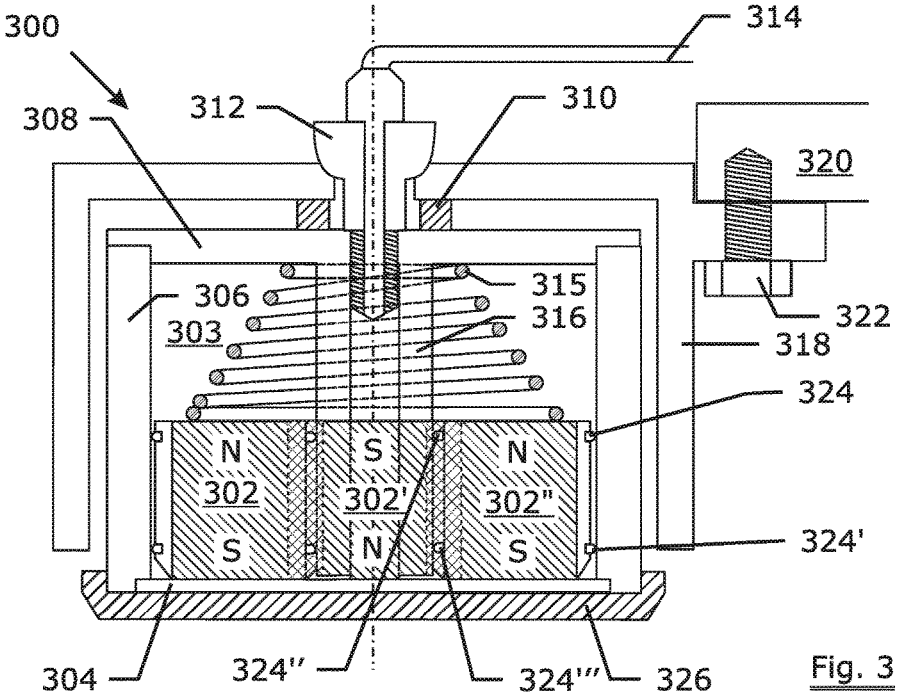
FIG. 3 is a cross-sectional view of a second embodiment of a magnet assembly.

Another advantageous embodiment of the magnet assembly 300 is shown in FIG. 3. In this embodiment the back cover 308 is made of aluminium. The directional compliance is achieved through a resilient collar 310—made of rubber—and a ball bolt 312. Analogously with the previous embodiment, the magnet array 303 is composed of six permanent magnets with alternating polarity. Now line 314 centrally feeds pressurised air through centre tube 316 to between the front cover 304 and permanent magnet array 303. Sliding seals 324, 324' , 324", and 324'" ensure sealing. When now pressurised air is supplied through line 314 the magnet array will move away from the position close to the spool. A conic spring 315 pushes the magnet array back, but the force of the spring is overcome by the force exerted by the pressurised air.

As long as the pressure remains on, the magnet array 303 remains in remote position i.e. the release state. As soon as the pressure disappears, the magnet array moves to the 'hold' state under action of the spring 314. There are therefore two different kinds of energy input: mechanical (the spring) and pneumatical. The advantage of this embodiment is that only one air feed line 314 is needed. On the other hand pneumatic energy is needed as long as the magnet array is in the release state. However, normally this will not take long as the time needed to remove or mount a spool is relatively short. In between removing and mounting a spool the pressure can be released.

Figure 4A:
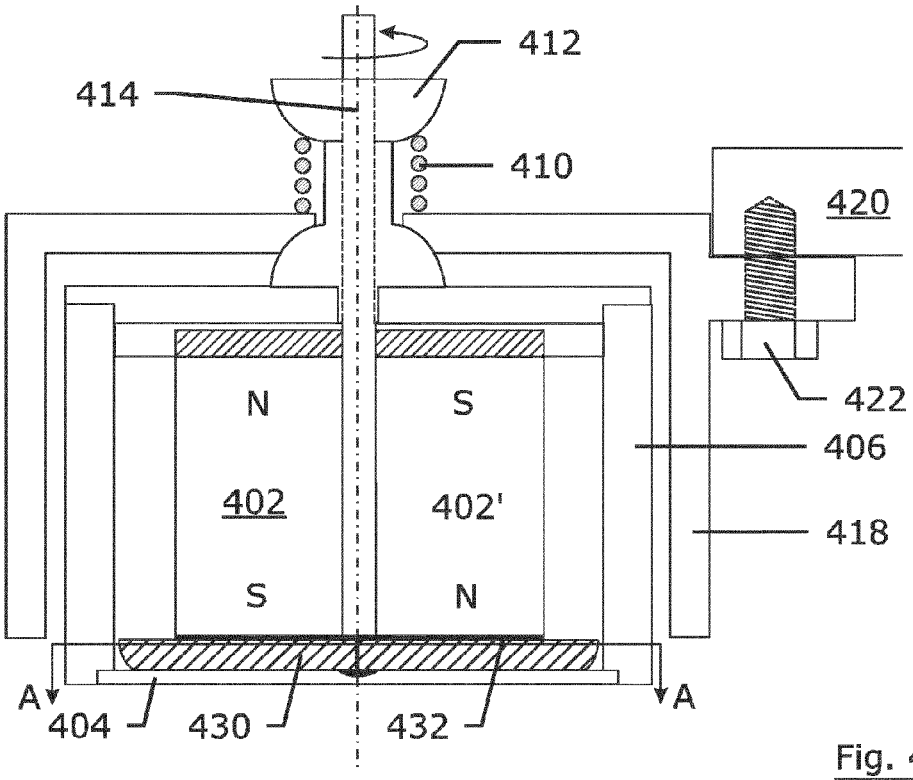
FIGS. 4*a* and 4*b* are cross-sectional views of a third embodiment of an exemplary magnet assembly.
Figure 4B:
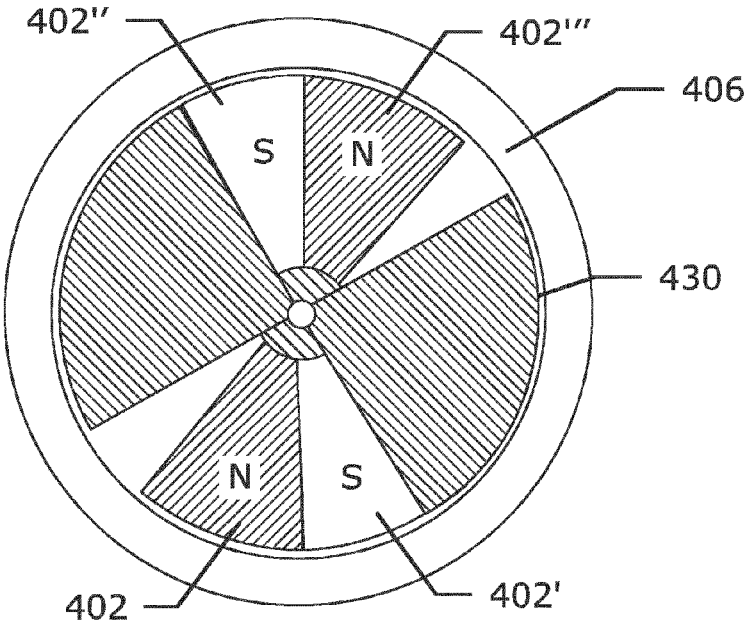

A further embodiment of a magnet assembly is shown in FIGS. 4*a* and FIG. 4*b* that is a cross section through plane AA of FIG. 4*a*. Again the assembly is mounted directionally compliant in box 418 through ball bolt 412. But now the four magnets 402, 402', 402" and 402'" remain stationary in the assembly. A shunt 430 made of a ferromagnetic material such as iron is mounted between front cover 404 and the permanent magnets. The segmented shunt 430 can turn in front of the poles of the permanent magnets by turning axis 414. Friction between magnets 402, 402', 402", 402'" —as the magnets strongly attract the shunt 430—is diminished by putting a low friction layer 432—such as Teflon® film-between magnets and shunt. Switching states is now realised by turning axis 414 (mechanical energy input). When the shunt 430 is turned in front of the magnets, the magnetic field is diverted through the shunt 430 and considerably weakened near the spool flange. Clearing the magnets from the shunt will enable the magnetic field to attract the spool again.

Figure 5A:
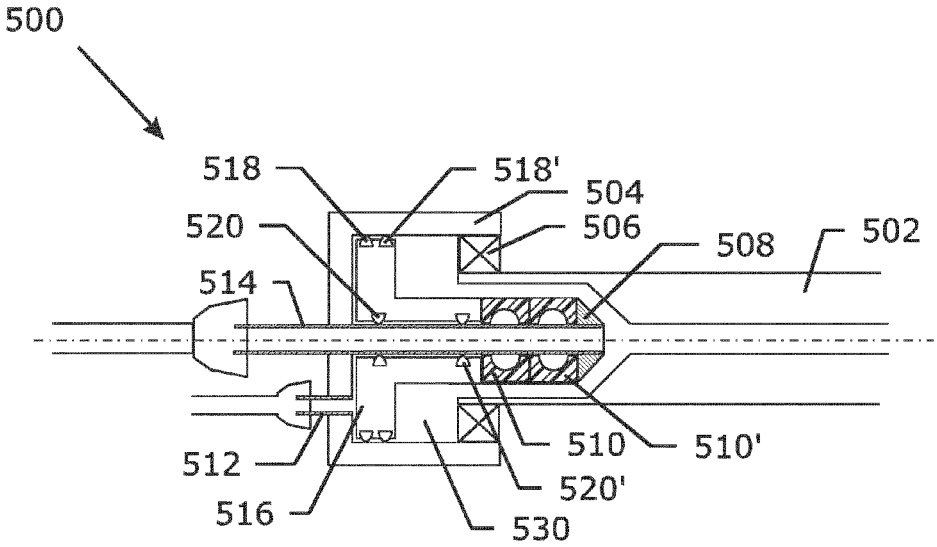
FIGS. 5*a* and 5*b* are axial cross sections of an embodiment of the energy coupling.
Figure 5B:
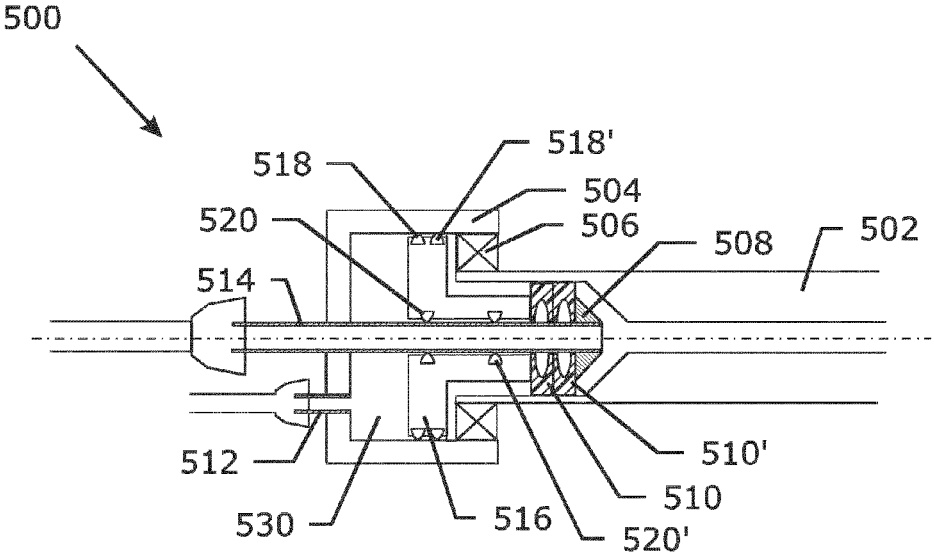

A convenient pneumatic energy coupling 110 between the wire winding installation and the spool fixation device is shown in FIG. 5*a* in the open state (for example during rotation of the axis 106) and in FIG. 5*b* in the closed state (when the axis 106 is stationary). The coupling is specifically convenient to cooperate with the magnet assemblies of the second embodiment (FIG. 3).

During the operation of the installation, the magnet assemblies do not need energy and no pneumatic input is needed through feed tube 514. Then axis 502—corresponding to axis 106 in FIG. 1—is turning while the coupling housing 504 remains stationary attached to the wire winding installation. Housing 504 and axis 502 are centred to one another through ball bearing 506.

The coupling is provided with a piston 516 axially moving on feed tube 514 in housing 504 and sealed by means of seals 518 and 518'. The piston pushes against elastomeric expandable seals 510, 510' that are held by the centre bored nut 508 that is threated on the feed tube 514. Elastomeric expandable seal 510 is attached to piston 516. The inner seals 520, 520' must therefore not be of high quality or can even be replaced with circlip rings.

When now the axis 106/502 has come to standstill and a spool is to be removed or loaded, the pressure chamber 530 is charged with pressurised air through inlet 512 as shown in FIG. 5*b*. The piston 516 compresses the elastomeric expandable seals 510, 510' that thereby radially expand and provide a seal between the hollow axis 502 and the feed tube 514. Now compressed air can be fed through feed tube 514 that on its turn will put the magnet assemblies 104, 104', 104" and 104'" in the 'release' state. A split tree is provided in the axis 106 to feed all magnet assemblies at the same time.

When the magnet assemblies are to be put in the hold state the pressure on feed tube 514 is released. Thereafter air is released from pressure chamber 530 and the elastomeric expandable seals push back piston 516 into the open position. The pneumatic coupling between rotatable axis 502/106 is now removed and the axis can freely turn. In this way the use of a rotatable seal—i.e. a seal between coaxial axes freely rotating relative to one another—can be prevented. Rotatable seals are maintenance intensive and prone to wear.

The operation cycle can further be simplified by using appropriate differential valves between inlets 514 and 512 and the pneumatic air supply such that the whole cycle can be completed from one source.

Figure 6:
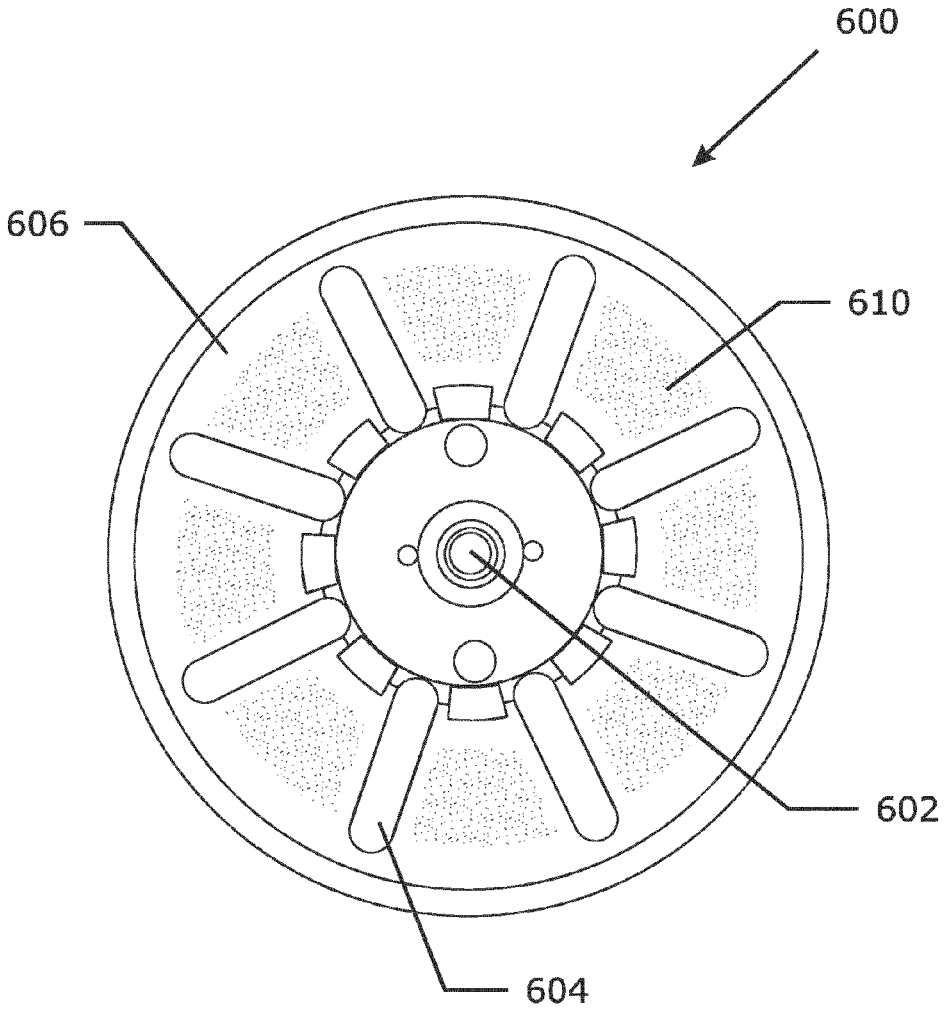
FIG. 6 shows a spool that is specifically designed for use with an embodiment of the spool fixation device.

FIG. 6 shows a spool that is specifically adapted for use with the spool fixation devices as explained here before. The spool 600 is made of steel sheet of 4 mm thick. As usual ribs 604 are stamped in the metal sheet to reinforce the flange. It is therefore that the magnet assemblies 104, 104', 104", and 104'" are protruding out of the plane of the rotatable flange 102 in order not to be hampered by the ribs. It goes without saying that the symmetry of the reinforcement ribs 604 (in this case 8-fold) must be compatible with the symmetry of the magnet assemblies (in this case 4-fold). Between the ribs the flat sectors that may come in contact with the magnet assemblies are provided with an anti-slip coating 610. If the magnet assemblies are provided with a rubber cover a suitable anti-slip coating may be a rough or serrated coating such as for example obtained by coating with a sand containing paint. When using such spool there is no need to align a drive hole with a drive pin which greatly simplifies the mounting of the spool.

The invention claimed is:

1. A spool fixation device for use in a wire winding installation comprising a rotatable flange for holding a spool with a spool flange that is magnetically attractable, said rotatable flange being provided with one or more magnet assemblies wherein said magnet assemblies are attached directionally compliant to said rotatable flange, wherein said one or more magnet assemblies is able to be selectively set to a 'hold' state for magnetically holding said spool flange to said rotatable flange or to a release state for releasing said spool flange from said rotatable flange and wherein said magnet assemblies comprise permanent magnet arrays that are sealed from the outside by a housing, wherein said magnet assemblies require energy input when in the release state or wherein said magnet assemblies require energy input when switching state, wherein said spool fixation device further comprises an energy coupling for coupling said energy input from the wire winding installation to said magnet assembly, wherein said energy coupling is able to be established when said spool fixation device is stationary and wherein said energy coupling is able to be broken when said spool fixation device is rotating.

2. The spool fixation device according to claim 1, wherein said energy input is one or two out of the group comprising electrical, pneumatical, or mechanical energy.

3. The spool fixation device according to claim 1, wherein said permanent magnet arrays are alternatingly moveable in said magnet assemblies from a close position for strong attraction of the spool flange in said 'hold' state to a remote position for weak attraction to the spool flange in said 'release' state.

4. The spool fixation device according to claim 1 further comprising a magnetic shunt, wherein said permanent magnet arrays and said magnetic shunt are relatively and alternatingly moveable in said magnet assemblies from a shunt configuration, wherein said permanent magnet arrays' field is shunted in said 'release' state to a coupling configuration, wherein the permanent magnet's field is not shunted in said 'hold' state.

5. The spool fixation device according to claim 1, wherein said magnet assemblies further comprise a high-friction layer at least at the surface intended to contact the spool flange.

6. The spool fixation device according to claim 1, wherein said rotatable flange is further provided with a centering pin for centering the spool to be held.

7. The spool fixation device according to claim 6, wherein the length of said centering pin is equal or larger than the width of the spool to be held.

8. The spool fixation device according to claim 6, wherein the length of said centering pin is shorter than the width of the spool to be held.

9. The spool fixation device according to claim 1, wherein said energy coupling is able to be established or able to be broken by the same type of energy as the energy input to the magnet assemblies.

10. The spool fixation device according to claim 9, wherein said energy coupling is able to be established or is able to be broken by the same energy input as the energy input to the magnet assemblies.

11. The spool fixation device according to claim 1, wherein said energy coupling is a rotatable energy coupling.

12. A wire winding installation provided with at least one spool fixation device according to claim 1.

13. The wire winding installation according to claim 12, suitable for winding spools with steel wire, said full winding spools having a mass of more than 100 kg.

* * * * *